US010729932B2

(12) United States Patent
Cooper

(10) Patent No.: US 10,729,932 B2
(45) Date of Patent: Aug. 4, 2020

(54) APPARATUS AND ASSOCIATED METHODS FOR FACILITATING EXERCISE AND TRAINING

(71) Applicant: Tricia Ann Cooper, Hickory, NC (US)

(72) Inventor: Tricia Ann Cooper, Hickory, NC (US)

( * ) Notice: Subject to any disclaimer, the term of this patent is extended or adjusted under 35 U.S.C. 154(b) by 144 days.

(21) Appl. No.: 15/813,081

(22) Filed: Nov. 14, 2017

(65) Prior Publication Data

US 2018/0133541 A1 May 17, 2018

Related U.S. Application Data

(60) Provisional application No. 62/422,020, filed on Nov. 14, 2016.

(51) Int. Cl.
*A63B 21/00* (2006.01)
*A63B 22/20* (2006.01)
(Continued)

(52) U.S. Cl.
CPC ..... *A63B 21/4037* (2015.10); *A63B 21/0442* (2013.01); *A63B 21/0552* (2013.01); *A63B 21/4039* (2015.10); *A63B 21/4043* (2015.10); *A63B 22/20* (2013.01); *A63B 21/4035* (2015.10); *A63B 23/0216* (2013.01);
(Continued)

(58) Field of Classification Search
CPC ..... A63B 21/0442; A63B 21/0552; A63B 21/4035; A63B 21/4037; A63B 21/4039; A63B 21/4043; A63B 22/20; A63B 23/0233; A63B 23/0216; A63B 2023/006; A63B 2209/00
See application file for complete search history.

(56) References Cited

U.S. PATENT DOCUMENTS 1,904,039 A * 4/1933 Bruder ..... A61H 7/001 606/240
3,895,794 A * 7/1975 England ..... A63B 22/16 482/146

(Continued)

OTHER PUBLICATIONS

Website: https://www.warehouseskateboards.com/help/Skateboard-Decks-Buying-Guidearchived: Apr. 7, 2014 retrieved: Aug. 20, 2019 (Year: 2014).*

(Continued)

*Primary Examiner* — Megan Anderson
(74) *Attorney, Agent, or Firm* — Christopher C. Dremann, P.C.; Christopher C. Dremann

(57) ABSTRACT

An apparatus and associated methods for facilitating exercise and training includes an elongate board having a top surface, a bottom surface, a length direction and a width direction. The top surface of the board defines a complex curvature including an end convex portion adjacent each opposed end of the board, a center convex portion at a center of the board, and a medial concave portion disposed between the center convex portion and each of the end convex portions. The opposed ends of an elongate strap are threaded upwardly within a slot from the bottom surface to the top surface. At least one pad is provided on the top surface of the board. An opening through the board defines a handhold for gripping and lifting the board. The board may further include a plurality of omnidirectional rollers depending from the bottom surface for movement in any direction.

15 Claims, 10 Drawing Sheets

(51) Int. Cl.

| | |
|---|---|
| ***A63B 21/055*** | (2006.01) |
| ***A63B 21/04*** | (2006.01) |
| *A63B 23/00* | (2006.01) |
| *A63B 23/02* | (2006.01) |

(52) U.S. Cl.
CPC ..... *A63B 23/0233* (2013.01); *A63B 2023/006* (2013.01); *A63B 2209/00* (2013.01)

(56) References Cited

U.S. PATENT DOCUMENTS

D237,813 S * 11/1975 Clarke ..... D21/688
5,558,624 A * 9/1996 Hepburn ..... A63B 21/015 482/130
5,795,277 A * 8/1998 Bruntmyer ..... A63B 21/0004 280/87.041
8,371,604 B1 * 2/2013 Soucy ..... A63C 5/0405 280/14.22
8,591,388 B2 * 11/2013 Jahns ..... A63B 23/0211 482/140
9,044,664 B1 * 6/2015 Canaday ..... A63C 5/0405
9,327,180 B2 * 5/2016 Adamczewski ..... A63C 5/0405
9,545,533 B2 * 1/2017 Boyer ..... A63B 69/0093
9,744,402 B2 * 8/2017 Klassen ..... A63B 22/16
10,610,728 B2 * 4/2020 Fano ..... A63B 21/0557
2011/0207587 A1 * 8/2011 De La Rambelje ..... A63B 21/4039 482/140
2015/0165266 A1 * 6/2015 Powers ..... A63B 22/16 482/142
2018/0133535 A1 * 5/2018 Derry ..... A63B 21/0442

OTHER PUBLICATIONS

Website: http://www.madehow.com/Volume-6/Skateboard.html archived: Feb. 20, 2006 retrieved: Aug. 20, 2019 (Year: 2006).*

* cited by examiner

APPARATUS AND ASSOCIATED METHODS FOR FACILITATING EXERCISE AND TRAINING

CROSS-REFERENCE TO RELATED APPLICATION

This United Sates non-provisional utility patent application claims priority to U.S. Provisional Patent Application No. 62/420,020 filed on Nov. 14, 2016, and entitled Apparatus For Facilitating Exercise And Training, the entire disclosure of which is incorporated herein by reference.

FIELD OF THE INVENTION

The present invention relate to apparatus and methods for facilitating exercise and training. More particularly, the invention is an apparatus and associated methods for facilitating low-impact physical conditioning designed to improve physical strength, flexibility and posture, and to enhance mental awareness. In exemplary embodiments shown and described herein, the invention is particularly useful as an apparatus and associated methods for facilitating Pilates exercise and yoga training.

BACKGROUND OF THE INVENTION

Pilates utilizes low-impact physical conditioning exercises designed to improve physical strength, flexibility and posture. Yoga utilizes breathing techniques, stretching and meditation to enhance health, happiness, relaxation and mental awareness. Certain individuals, however, are intimidated to participate in Pilates exercise or yoga training due to the physicality or the body positions that these exercise and training activities require. For example, older adults often lack the flexibility necessary to perform certain Pilates exercises or to obtain certain yoga positions. Furthermore, people of all ages may lack the stability and balance required for certain Pilates exercises and yoga training. As a result, many individuals do not have confidence in their physical abilities and attributes to fully participate in Pilates type exercises or yoga type training.

The apparatus currently existing for facilitating Pilates exercises and yoga training include mats, blocks, ropes, elastic bands and the like. None of the known apparatus, however, are especially suited for increasing the flexibility, stability and/or balance of an individual to perform Pilates exercises and to obtain yoga training positions. Consequently, none of the known apparatus provide individuals with sufficient confidence to participate in Pilates type exercises and/or yoga type training. In particular, none of the existing apparatus provide adequate support and contribute to the form desired to properly perform certain Pilates exercises and to obtain certain yoga training positions.

It is therefore apparent that an apparatus and methods are needed for facilitating exercise and training. More particularly, an apparatus and associated methods are needed for facilitating Pilates type exercise and yoga type training. Such an apparatus and methods are needed that increase or improve the flexibility, stability and/or balance necessary to perform certain Pilates exercises or to obtain certain yoga training positions. Such an apparatus and methods are further needed to provide individuals with sufficient confidence to participate in Pilates type exercise and/or yoga type training. In particular, an apparatus and associated methods are needed to provide adequate support and contribute to the form desired to properly perform certain Pilates exercises and to obtain certain yoga training positions.

Certain aspects, objects, features and advantages of the present invention will be made apparent, or will be readily understood and appreciated by those skilled in the relevant art, as exemplary embodiments of the invention shown in the accompanying drawing figures are described in greater detail hereinafter. It is intended that all such aspects, objects, features and advantages of the invention envisioned by this disclosure of exemplary embodiments be encompassed by the scope of protection of the appended claims, given their broadest reasonable interpretation and claim construction from the viewpoint of one of ordinary skill in the art within the context of this disclosure. As such, the terms used in this disclosure should be construed according to their ordinary and customary meaning to one of ordinary skill in the art at the time of this invention. The aspects, objects, features and advantages of the invention, as well as others not expressly disclosed, may be accomplished by one or more of the exemplary embodiments described herein and illustrated in the accompanying drawings. However, it should be appreciated that the exemplary embodiments and the accompanying drawing figures are merely illustrative of the invention and its various forms, and that many modifications, changes, revisions and substitutions may be made to any of the exemplary embodiments without departing from the general concepts of the invention when broadly interpreted and construed.

BRIEF DESCRIPTION OF THE DRAWINGS

The aforementioned aspects, objects, features and advantages of the present invention, as well as the exemplary embodiments of the invention, will be more fully understood and appreciated when considered in conjunction with the accompanying drawing figures, in which like reference characters designate the same or similar parts throughout the several views.

DETAILED DESCRIPTION OF EXEMPLARY EMBODIMENTS OF THE INVENTION

Figure 1:
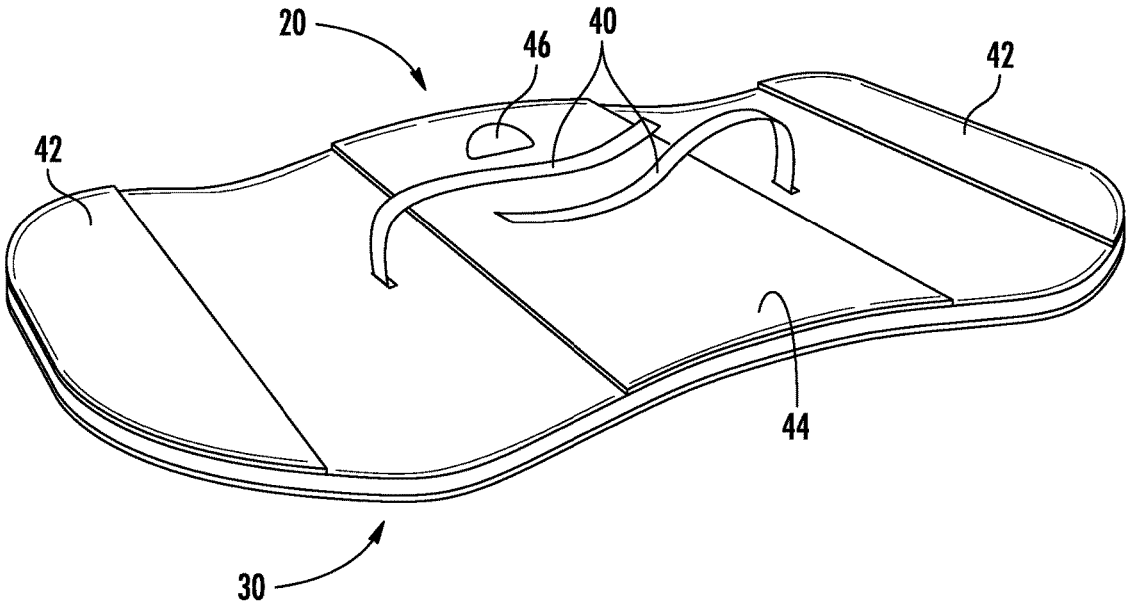
FIG. 1 is a top perspective view of an apparatus for facilitating exercise and training according to an exemplary embodiment of the present invention.

The following is a detailed description of various exemplary embodiments of an apparatus and associated methods for facilitating exercise and training in accordance with the present invention. Each of the exemplary embodiments is described more fully hereinafter with reference to one or more of the accompanying drawing figures. In each of the exemplary embodiments shown and described herein, an apparatus, indicated generally by reference character 20, is useful for facilitating physical exercise and training. An apparatus 20 according to the present invention is particularly useful for facilitating Pilates type exercise and yoga type training. However, it is not intended for the use of the apparatus 20 to be limited in any manner by the exemplary embodiments shown and described herein. Instead, it is expected that the present invention will be given the broadest reasonable interpretation consistent with this disclosure and the exemplary embodiments illustrated herein and the terms used herein will be given their ordinary and customary meanings as would be understood by a person of ordinary skill in the art at the time of the invention unless another construction is expressly provided.

In one aspect, the invention is an apparatus for facilitating physical exercise and training. FIGS. 1-4 show an exemplary embodiment of an apparatus 20 according to the invention that is configured in the form of a relatively thin and generally planar, yet contoured, board 30. The board 30 is generally stiff, but has a predetermined degree of flexibility. Board 30 may be made of any material that provides the desired degree of flexibility suitable for the form of exercise and/or training to be performed by a user, such as natural wood, plastic or composite material. By way of example and not limitation, the board 30 may be formed of two or more thin layers of a natural wood that are laminated (pressed and bonded) together to form the desired shape, as will be described in greater detail hereinafter. In one example, the board 30 is formed of a plurality of thin layers of plywood that are laminated (pressed and bonded) together into a laminate. The laminate may be hydrated and/or heated, for example in a conventional steam box, and then subjected to a bending force to form the desired shape. Alternatively, the laminate may be formed into the desired shape by positioning the laminate within a jig and applying pressure to the laminate. In another example, the board 30 may be formed from a relatively thin, generally planar block of an inherently flexible material and machined into the desired shape. In yet another example, the board 30 may be formed from an inherently flexible plastic or composite material that is molded into the desired shape. Regardless, the board 30 has a predetermined shape that is sufficiently stiff to provide stability, yet at the same time has a desired degree of flexibility as a result of its structural properties, namely geometry and material stiffness. Generally, the board 30 will have sufficient strength and stiffness to support the weight of a person up to as much as four hundred pounds (400 lbs.), while at the same time having sufficient flexibility to absorb and evenly distribute a portion of the weight of a person performing a physical exercise or training using the board 30.

Figure 2:
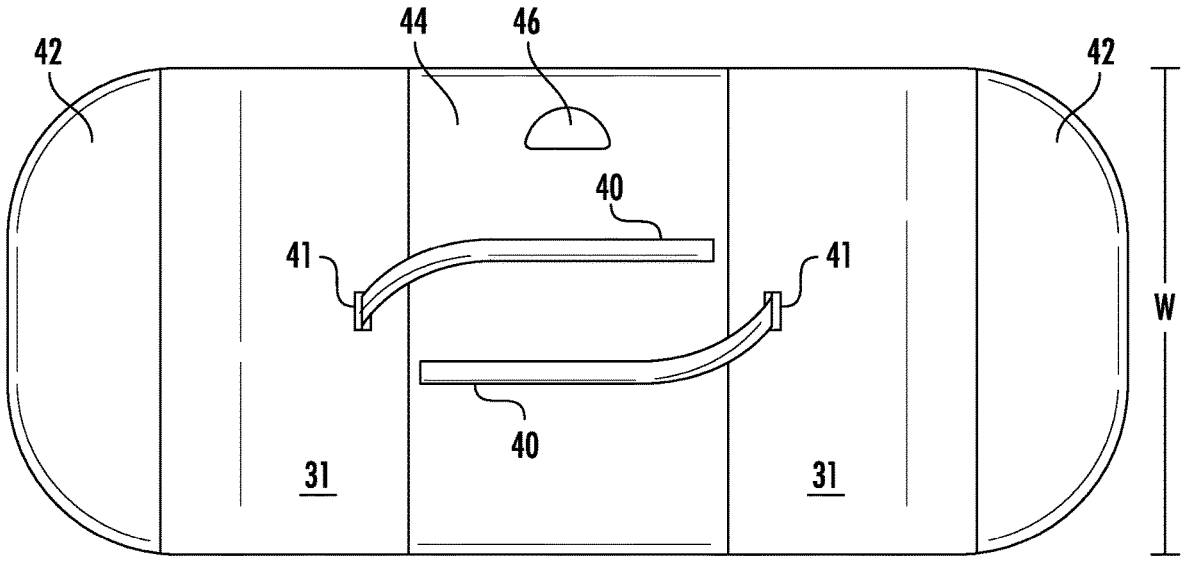
FIG. 2 is a top view of the apparatus shown in FIG. 1.
Figure 3:
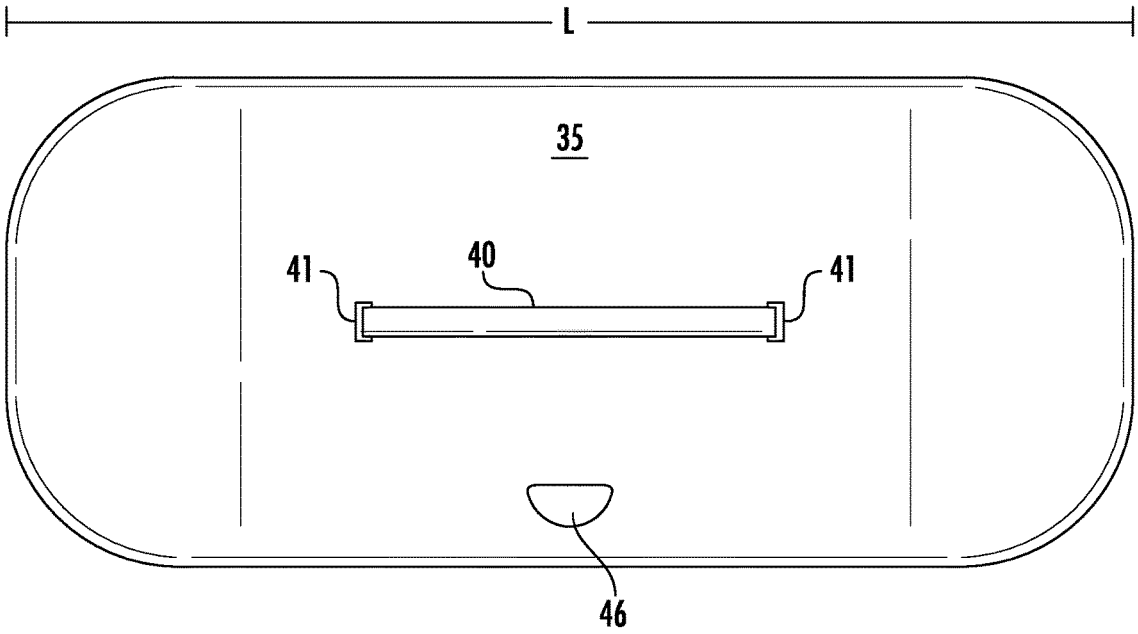
FIG. 3 is a bottom view of the apparatus shown in FIG. 1.
Figure 4:
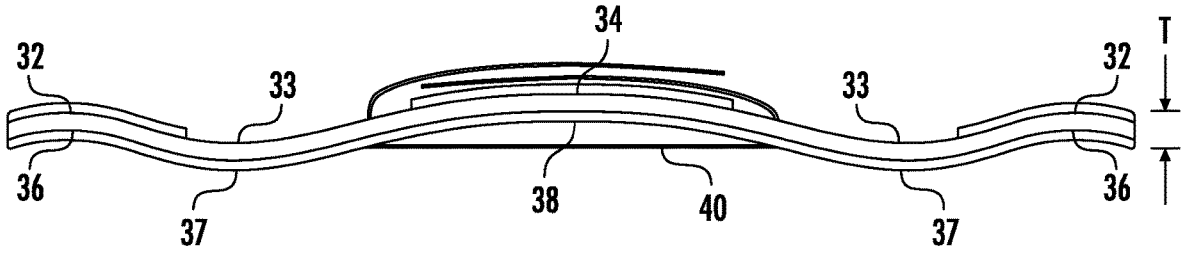
FIG. 4 is a side elevation view of the apparatus shown in FIG. 1.

FIG. 1 shows a top perspective view of the board 30. FIG. 2 shows a top view of the board 30. FIG. 3 shows a bottom view of the board 30. FIG. 4 shows a side elevation view of the board 30. As illustrated herein, the footprint of the board 30 defines an elongate, substantially rectangular shape that is generally planar, yet contoured. If desired, the corners of the board 30 may be chamfered, angled, curved, rounded or the like for aesthetic purposes and/or to reduce the likelihood that the corners will contact and damage other structures, such as walls or doors, during transport. In one example, the generally rectangular footprint of the board 30 has an aspect ratio of length-to-width between about 1.5:1 and about 3:1. More preferably, the board 30 has an aspect ratio of length-to-width at least about 2:1. By way of example and not limitation, the board 30 may have a length between about 36 inches and about 72 inches, and a width between about 18 inches and about 36 inches. In a particularly advantageous example, the board 30 has a length of about 60 inches and a width of about 30 inches. The thickness of the board 30 is substantially constant and is between about 0.5 inches and about 1.5 inches depending on the flexibility of the material of the board and the length-to-width aspect ratio.

As best seen in FIG. 1 and FIG. 4, the board 30 has a contour in the direction of its length, indicated by reference character L, that defines a complex curvature. At the same time, the shape of the board 30 is generally linear in the direction of its width, indicated by reference character W, at any point along the length L of the board 30. Preferably, the contour along the length L of the board 30 is substantially symmetric about an axis located at the center of the board 30 that extends in the direction of the width W. Likewise, the contour across the width W of the board 30 is substantially symmetric about an axis located at the center of the board 30 that extends in the direction of the length L. If the board 30 is made for example of a wood material, the direction of the grain of the wood is preferably aligned in the direction of the width W of the board. As previously mentioned, the thickness, indicated by reference character T, of the board 30 remains substantially constant in both the direction of the length L and the direction of the width W of the board 30.

As best seen in the side elevation view of FIG. 4, the shape of the board 30 defines a complex curvature along the top surface 31 comprising convex portions 32 adjacent the opposed ends of the board, and a convex portion 34 at the center of the board 30 between the opposed ends. Each of the convex portions 32 defines a local apex on the top surface 31 adjacent an opposed end of the board 30 and the convex portion 34 defines a local apex on the top surface 31 at the center of the board 30. Consequently, a concave portion 33 is disposed medially between the convex portion 34 at the center of the board 30 and each of the convex portions 32 adjacent the opposed ends of the board 30. As a result, the board 30 defines a wave-like serpentine shape in the lengthwise direction along the length L of the board 30. As will be readily understood and appreciated, the shape of the board 30 defines an opposite complex curvature along its bottom surface 35 comprising concave portions 36 adjacent the opposed ends of the board, and a concave portion 38 at the center of the board between the opposed ends. Consequently, a convex portion 37 is disposed medially between the center concave portion 38 and each of the end concave portions 36. The complex curvature of the board 30 in conjunction with its flexibility resulting from the geometry and material properties of the board 30 provides a desired degree of resilience and elasticity that is beneficial to a user. By way of example and not limitation, a user may stand on the center convex portion 34 on the top surface 31 of the board 30 so that the medial concave portions 33 (i.e., convex portions 37) in contact with a solid surface, such as a floor, provide a desired degree of resilience during physical exercise or training. The elasticity causes the board 30 to return to its original complex curvature following the exercise or training.

If desired, the board 30 may be provided with an optional pair of straps 40, or alternatively as shown herein, a single strap 40 having opposed ends. The strap 40 may be useful to certain users as a means for stabilizing themselves during exercise or training. As shown and described herein, a pair of openings in the form of slots 41 are formed through the thickness T of the board 30 adjacent the convex portion 34 (concave portion 38) on opposite sides of the center of the board 30 in the lengthwise direction. Each of the slots 41 is configured to receive an opposed end of the elongate strap 40. The opposed ends of the strap 40 are threaded upwardly within the slots 41 through the thickness T of the board 30 from the bottom surface 35 to the top surface 31. If desired, loops, handholds or the like may be provided at one or both of the opposed ends of the strap 40. In addition, the strap 40 may be made of a relatively elastic material so as to provide increased resistance to the user as the length of the strap 40 is increased.

If desired, the top surface 31 of the board 30 may be provided with one or more optional pads as shown herein. The board 30 may comprise a pair of end pads 42 positioned on the top surface 31 of the board 30 at the opposed ends over the convex portions 32 defined by the complex curvature. In addition, or in the alternative, the board 30 may comprise a center pad 44 positioned on the top surface 31 of the board 30 at the center over the convex portion 34 defined by the complex curvature. The optional pads 42, 44 preferably provide a relatively soft, comfortable surface when a user is in a lying down or sitting position on the board 30 during exercise or training.

If desired, the board 30 may be provided with an optional handhold 46. As shown herein and described herein, a handhold 46 is defined by at least one opening formed through the thickness T of the board 30 adjacent one or both of the opposed lengthwise edges of the board 30. Preferably, the handhold 46 defines a half-moon shaped opening so as to readily conform to a gripping hand of a user. Handhold 46 is configured to permit a user to more easily lift and carry the board 30 for transport from one location to another.

Figure 5:
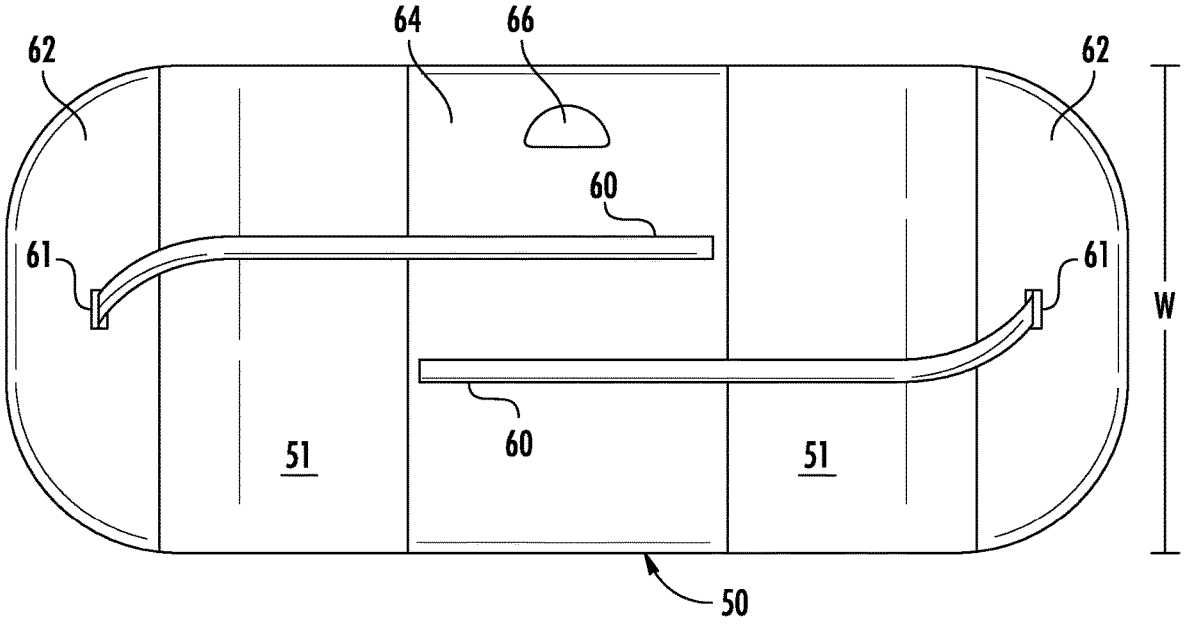
FIG. 5 is a top view of an apparatus for facilitating exercise and training according to another exemplary embodiment of the present invention.
Figure 6:
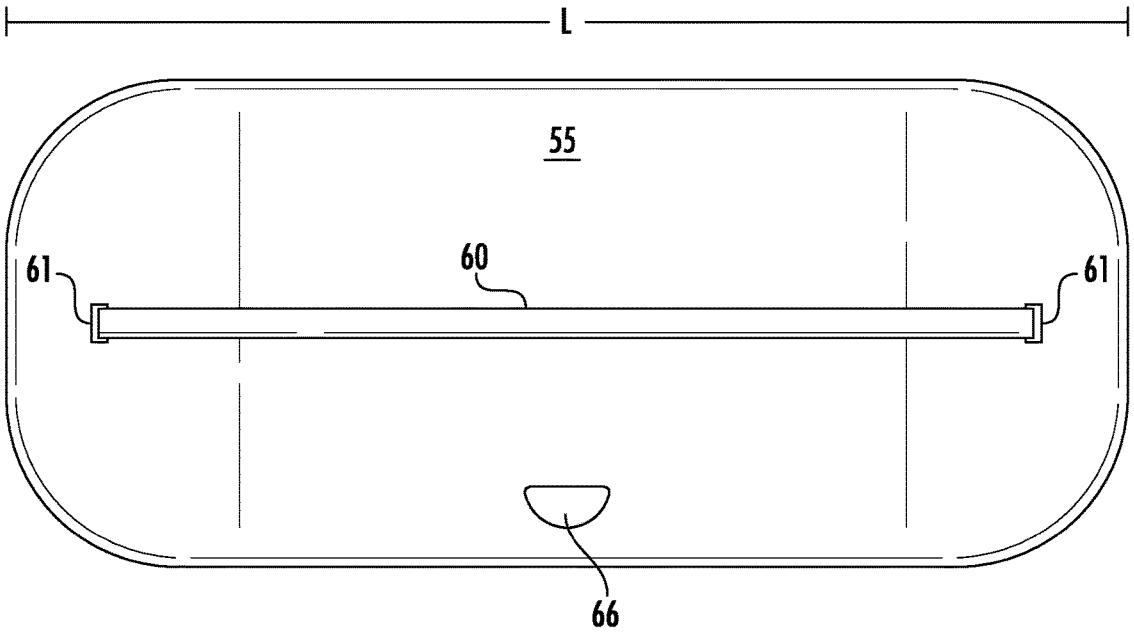
FIG. 6 is a bottom view of the apparatus shown in FIG. 5.
Figure 7:
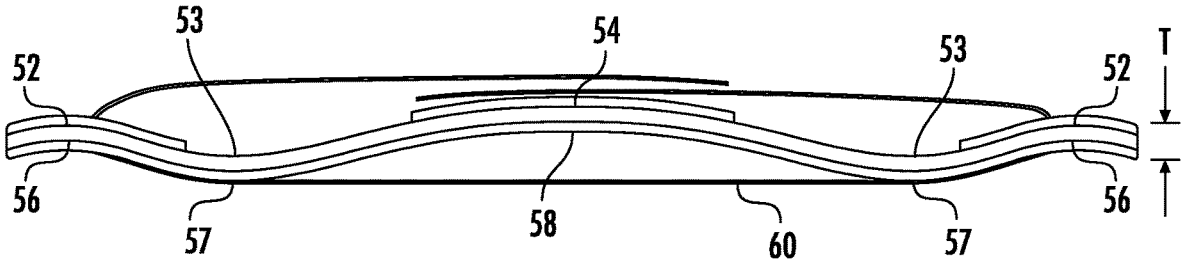
FIG. 7 is a side elevation view of the apparatus shown in FIG. 5.
Figure 8:
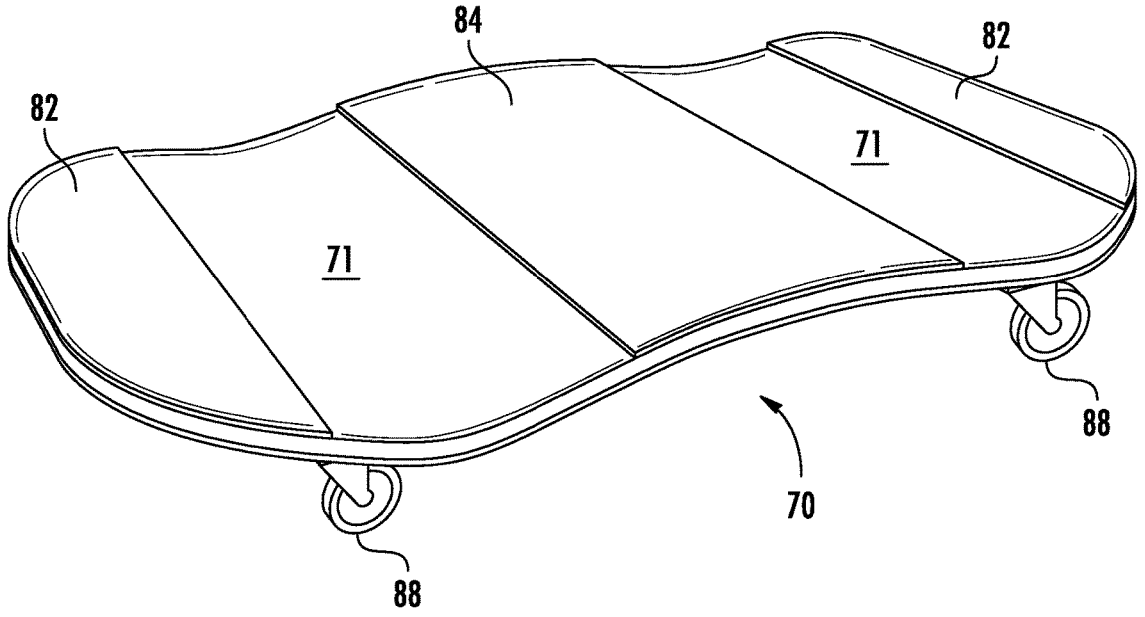
FIG. 8 is a top perspective view of an apparatus for facilitating exercise and training according to yet another exemplary embodiment of the present invention.
Figure 9:
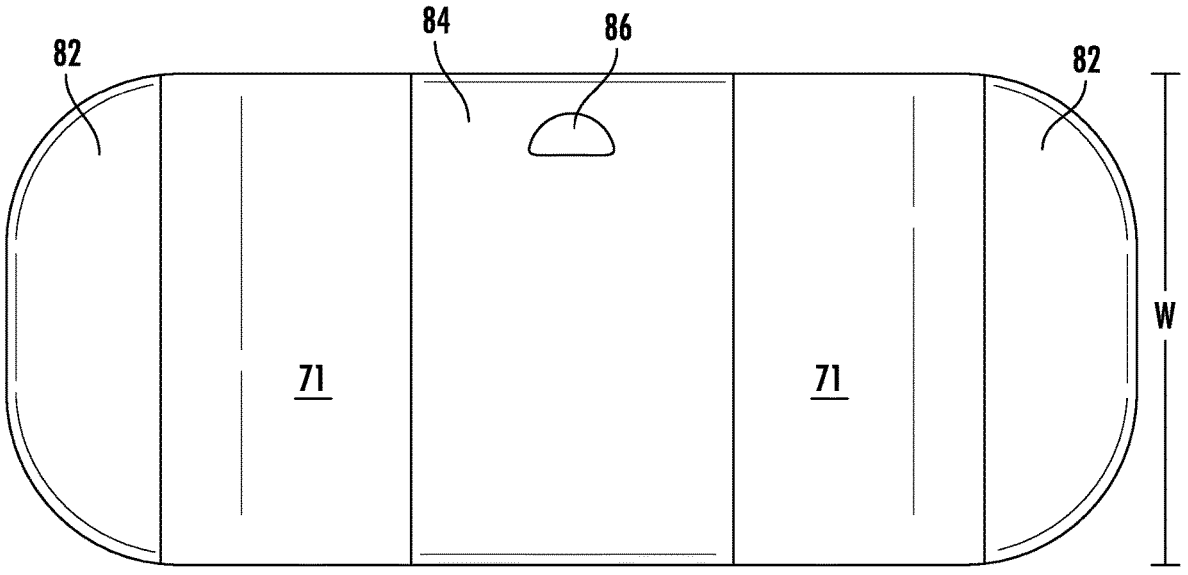
FIG. 9 is a top view of the apparatus shown in FIG. 8.

FIGS. 5-7 show another exemplary embodiment of an apparatus 20 for facilitating exercise and training according to the invention. In this embodiment, the apparatus 20 is likewise configured in the form of a relatively thin and generally planar, yet contoured, board 50. Board 50 is essentially the same in all relevant respects as the board 30 shown in FIGS. 1-4 and described hereinabove. In particular, board 50 defines a complex curvature comprising end convex portions 52, center convex portion 54 and medial concave portions 53 along the top surface 51 of the board 50, as well as corresponding end concave portions 56, center concave portion 58 and medial convex portions 57 along the bottom surface 55 of the board 50. In addition, board 50 may comprise optional end pads 62 and/or optional center pad 64, as well as an optional handhold 66 adjacent one or both of the opposed lengthwise edges of the board 50.

The board 50 illustrated in FIGS. 5-7 is essentially the same as the board 30 previously described with the exception of the position of the pair of straps 60, or alternatively as shown herein, the single strap 60 having opposed ends. In this embodiment, a pair of openings in the form of slots 61 are formed through the thickness T of the board 50 at the convex portions 52 (concave portions 56) on opposite sides of the center of the board 50 in the lengthwise direction. The slots 61 are configured to receive the opposed ends of the elongate strap 60. The opposed ends of the strap 60 are threaded upwardly within the slots 61 through the thickness T of the board 50 from the bottom surface 55 to the top surface 51. If desired, loops, handholds or the like may be provided at one or more of the opposed ends of the strap 60. In addition, the strap 60 may be made of a relatively elastic material so as to provide increased resistance to the user as the length of the strap 60 is increased.

FIGS. 8-11 show yet another exemplary embodiment of an apparatus 20 for facilitating exercise and training according to invention. In this embodiment, the apparatus 20 is likewise configured in the form of a relatively thin and generally planar, yet contoured, board 70. Board 70 is substantially similar to the board 30 shown in FIGS. 1-4 and/or the board 50 shown in FIGS. 5-7. However, board 70 is preferably significantly smaller in dimensions than either the board 30 or the board 50. By way of example and not limitation, the board 70 is about one-third as large as the board 30 or the board 50. The length-to-width aspect ratio of the board 70 is likewise preferably about 2:1. As a result, the length L of the board 70 is between about 18 inches and about 30 inches, while the width W of the board 70 is between about 9 inches and about 15 inches. The thickness T of the board 70 is likewise substantially constant and is between about 0.5 inches and about 1.5 inches depending on the flexibility of the material of the board and the length-to-width aspect ratio.

Figure 11:
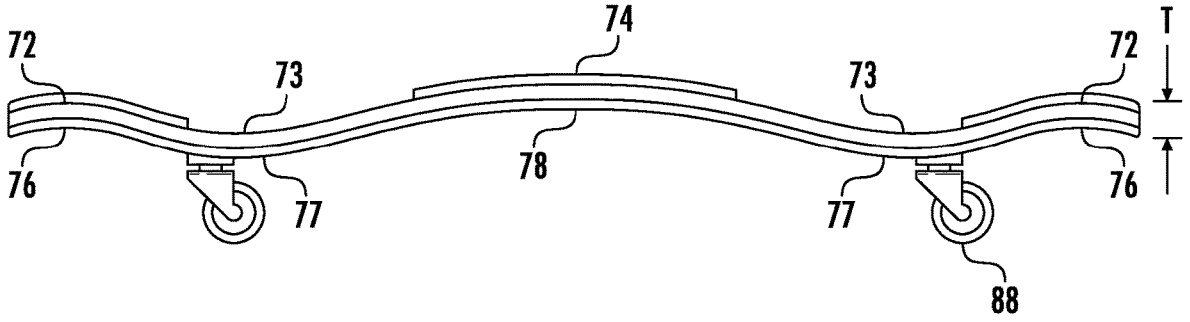
FIG. 11 is a side elevation view of the apparatus shown in FIG. 8.

Regardless, the shape of the board 70 likewise defines a complex curvature along its length L in essentially the same manner as previously described with respect to the board 30 and the board 50. In particular, as best seen in FIG. 11, the top surface 71 of board 70 defines a complex curvature comprising convex portions 72 (concave portions 76) adjacent each opposed end of the board 70 and a convex portion 74 (concave portion 78) at the center of the board 70. Board 70 further comprises concave portions 73 (convex portions 77) disposed medially between the center convex portion 74 (concave portion 78) and each of the end convex portions 72 (concave portions 76).

If desired, the top surface 71 of the board 70 may be provided with one or more optional pads. As shown and described herein, the board 70 may comprise a pair of end pads 82 positioned on the top surface 71 of the board 70 at the opposed ends over the convex portions 72 defined by the complex curvature. In addition, or in the alternative, the board 70 may comprise a center pad 84 positioned on the top surface 71 of the board 70 at the center over the convex portion 74 defined by the complex curvature. The optional pads 82, 84 preferably provide a relatively soft, comfortable surface when a user is positioned in a lying down or sitting position on the board 70 during exercise or training.

If desired, the board 70 may be provided with an optional handhold 86. As shown and described herein, a handhold 86 is defined by at least one opening formed through the thickness T of the board 70 adjacent one or both opposed lengthwise edges of the board 70. Preferably, the handhold 86 is defined by a half-moon shaped opening so as to readily conform to the gripping hand of a user. Handhold 86 is configured to permit a user to more easily lift and carry the board 70 for transport from one location to another.

The board 70 further comprises a plurality of omnidirectional rollers 88 depending from a bottom surface 75 of the board 70. The rollers 88 may be any suitable component, such as wheels, bearings, castors or the like, that permit the board 70 to be moved with minimal force in any direction. As such, rollers 88 permit a user to place his or her feet comfortably on the top surface 71 of the board 70, and more particularly, in the area of the medial concave portions 73, and then move the board 70 in any desired direction. In one suitable example, a user supports his or her body in the air with the hands positioned on the floor and the feet positioned on the top surface 71 of the board 70. The user then moves the feet in a generally circular clockwise or counterclockwise exercise motion. This exercise loosens the user's hip joints and strengthens the user's core abdominal muscles. Accordingly, the board 70 may be commonly referred to as an "abdominal muscle strengthening board," or similarly a "core exercise board."

Figure 10:
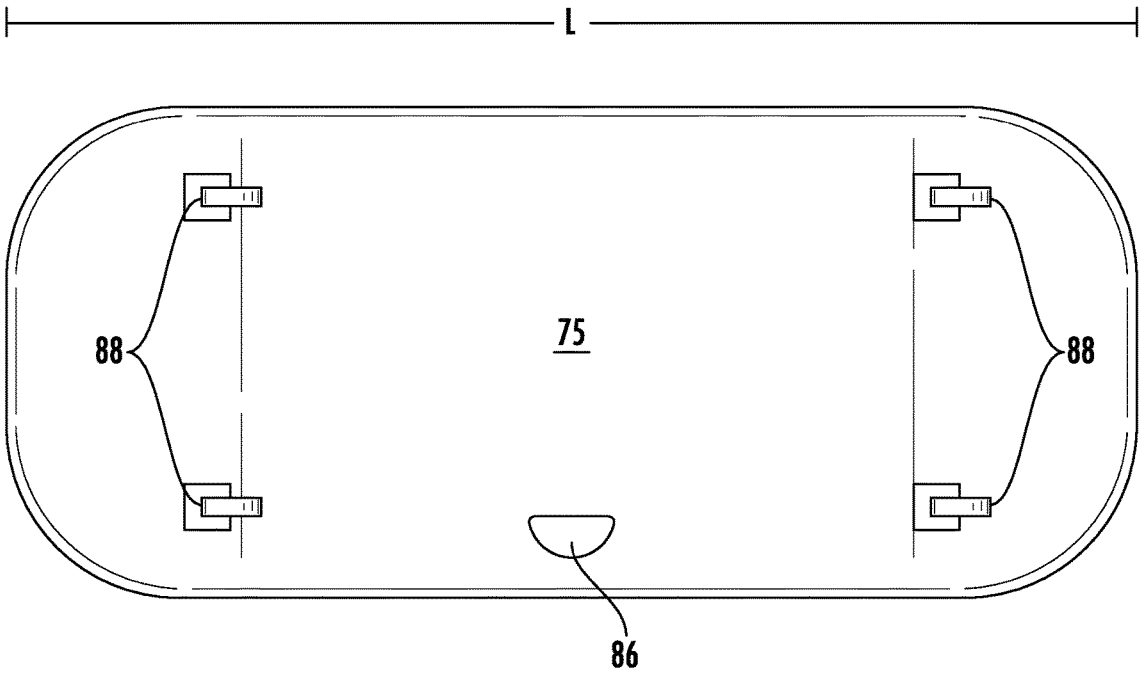
FIG. 10 is a bottom view of the apparatus shown in FIG. 8.

Existing abdominal muscle strengthening boards and core exercise boards permit a similar circular motion, but are typically round in shape and do not have the stability or the flexibility that is provided by the geometry and the material properties of a board 70 constructed in accordance with the invention. As best shown in FIG. 10, an exemplary embodiment of a board 70 constructed in accordance with the invention comprises four (4) rollers 88 positioned adjacent the opposed ends of the board 70 and the opposed lengthwise edges of the board 70 in a generally rectangular pattern. As such, the rollers 88 provide stability in both the direction of the width W of the board 70 and the direction of the length L of the board 70.

Figure 12:
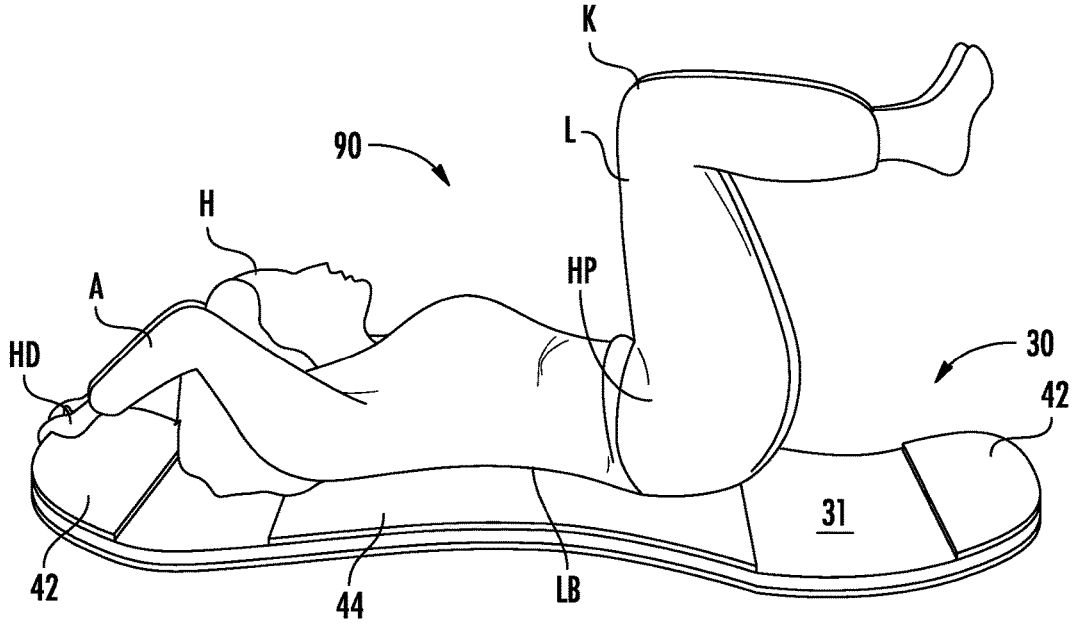
FIG. 12 illustrates a method associated with the apparatus shown in FIG. 1 for facilitating exercise and training according to an exemplary embodiment of the present invention.

FIG. 12 illustrates a method of using the apparatus 20 for facilitating physical exercise and training according to an exemplary embodiment of the invention. A user 90 is positioned face-up and lying on the top surface 31 of the board 30 in the length L direction. The user 90 grips the widthwise edge of the convex portion 32 at one of the opposed ends of the board 30 with the hands HD extended over the head H. At the same time, the legs L are bent about ninety degrees at the hips HP and about ninety degrees at the knees K. The end pad 42 cushions and protects the hands HD of the user 90 and the center pad 44 cushions and protects the lower back LB and hips HP of the user. In this position, the curvature of the convex portion 34 at the center of the board 30 serves to support the sacrum and the lumbar spine of the user 90 and thereby facilitates the user 90 to accomplish confident and strong abdominal exercise and training.

Figure 13:
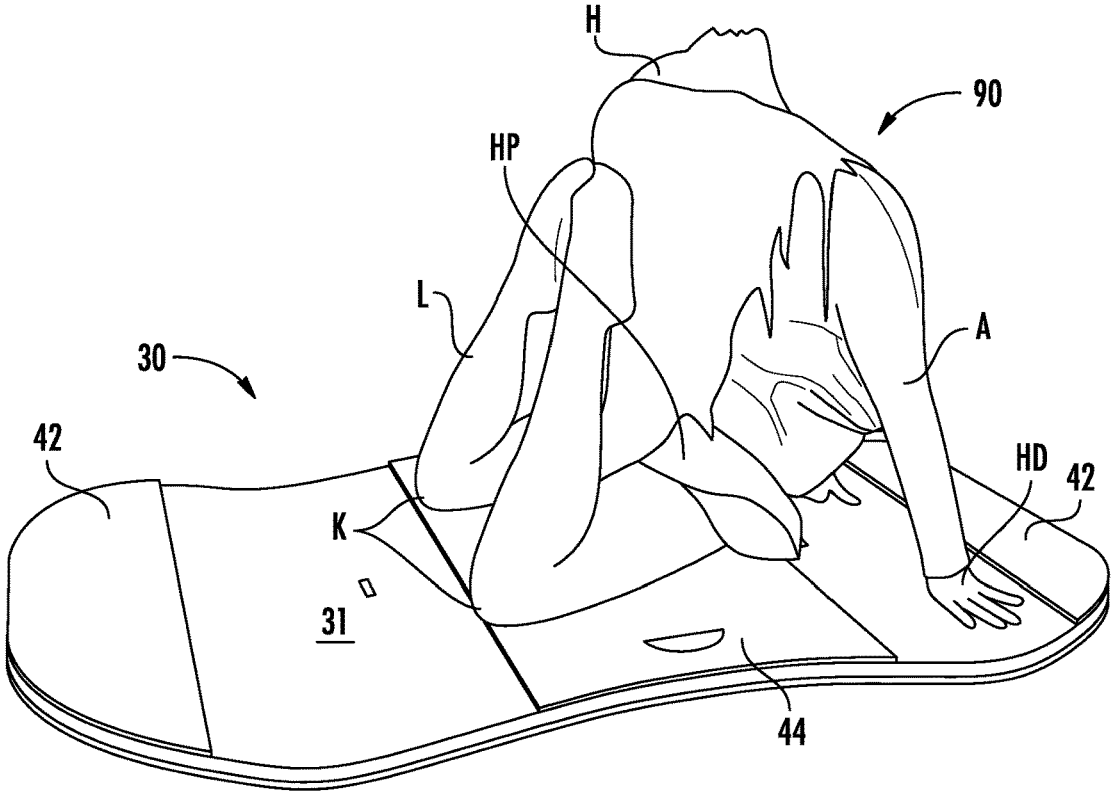
FIG. 13 illustrates a method associated with the apparatus shown in FIG. 1 for facilitating exercise and training according to another exemplary embodiment of the present invention.

FIG. 13 illustrates a method of using the apparatus 20 for facilitating physical exercise and training according to another exemplary embodiment of the invention. A user 90 is positioned on the hands HD and knees K on the top surface 31 of the board 30 in the length L direction. The user 90 places the hands HD on the top surface 31 within the concave portion 33 of the board 30 adjacent one of the opposed ends of the board 30. The user 90 fully extends the arms A while arching the upper body and head H backwards from the hips HP. At the same time, the user 90 bends the lower legs L backwards at the knees K at least about ninety degrees. The center pad 44 cushions and protects the knees K, upper legs L and hips HP of the user. In this position, the curvature of the convex portion 34 at the center of the board 30 serves to allow the knees K and the hips HP of the user 90 to drop downwards relative to the upper legs L of the user 90 into the concave portions 33 of the board 30, and thereby helps the user 90 to more comfortably accomplish a deeper posture for facilitating exercise and training.

Figure 14:
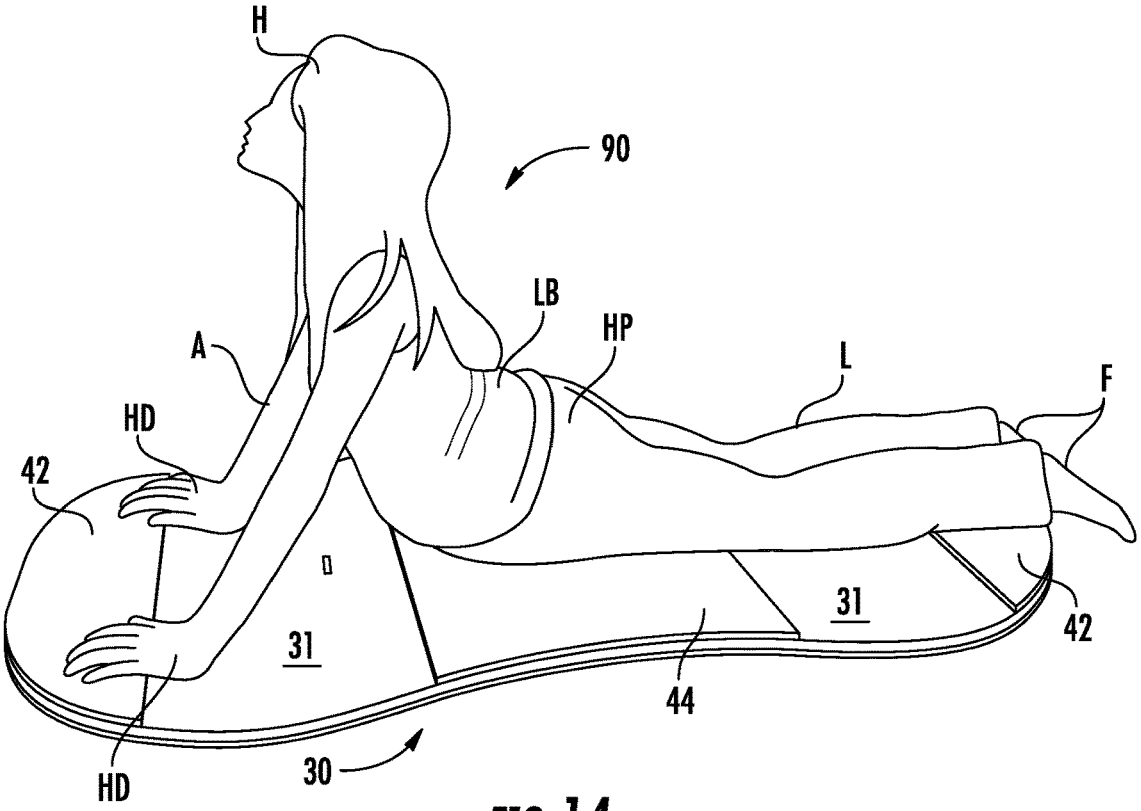
FIG. 14 illustrates a method associated with the apparatus shown in FIG. 1 for facilitating exercise and training according to yet another exemplary embodiment of the present invention.

FIG. 14 illustrates a method of using the apparatus 20 for facilitating physical exercise and training according to another exemplary embodiment of the invention. A user 90 is positioned lying face-down on the top surface 31 of the board 30 in the length L direction. The user 90 places the hands HD on the end pad 42 over the convex portion 32 at one of the opposed ends of the board 30 with the hands HD and arms A extending forward from the head H. The user 90 fully extends the arms A while arching the lower back LB and head H backwards from the hips HP. The lower legs L of the user 90 remain relatively straight and extending rearward on the top surface 31 of the board 30. The center pad 44 cushions and protects the hips HP of the user. One of the end pads 42 cushions and protects the hands HD of the user 90, while the other of the end pads 42 cushions and protects the lower legs L and/or feet F of the user 90. In this position, the curvature of the convex portion 34 at the center of the board 30 serves to support the hips HP of the user 90 and the convex curvature at the opposed ends of the board 30 serve to support the hands HD, lower legs L and/or feet F of the user 90. The convex curvature 34 at the center of the board 30 keeps the hips HP higher and allows the legs L of the user 90 to drop downwards into the concave portion 33 of the board 90, thereby providing a deeper stretch in the hip flexors and a higher chest opening to strengthen the lower back L and to facilitate exercise and training of the abdominal muscles.

Figure 15:
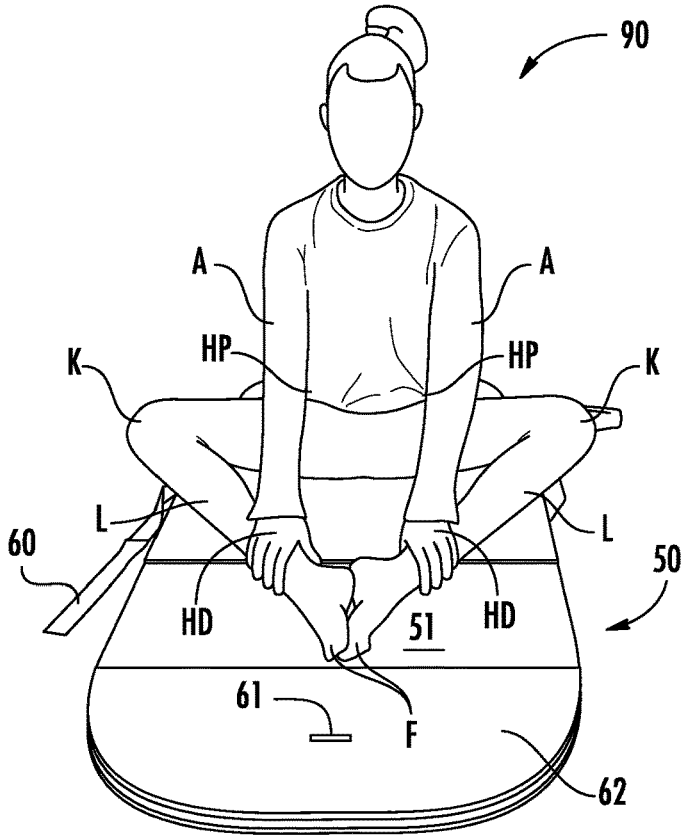
FIG. 15 illustrates a method associated with the apparatus shown in FIG. 1 for facilitating exercise and training according to yet another exemplary embodiment of the present invention.

FIG. 15 illustrates a method of using the apparatus 20 for facilitating physical exercise and training according to another exemplary embodiment of the invention. A user 90 is positioned sitting on the top surface 51 of the board 50 in the length L direction. The user 90 places the hips HP over the convex portion 54 at the center of the board 50. The user 90 fully extends the arms A and the legs L slightly forwards while bending the lower legs L inwards at the knees K less than about ninety degrees. The center pad 64 cushions and protects the hips HP of the user. In this position, the curvature of the convex portion 54 at the center of the board 60 allows the lower legs L, the hands HD and the feet F to drop downwards relative to the hips HP of the user 90, and thereby provides for a wider hip opener and a for more relaxed and deeper hip opener to facilitate exercise and training.

Figure 16:
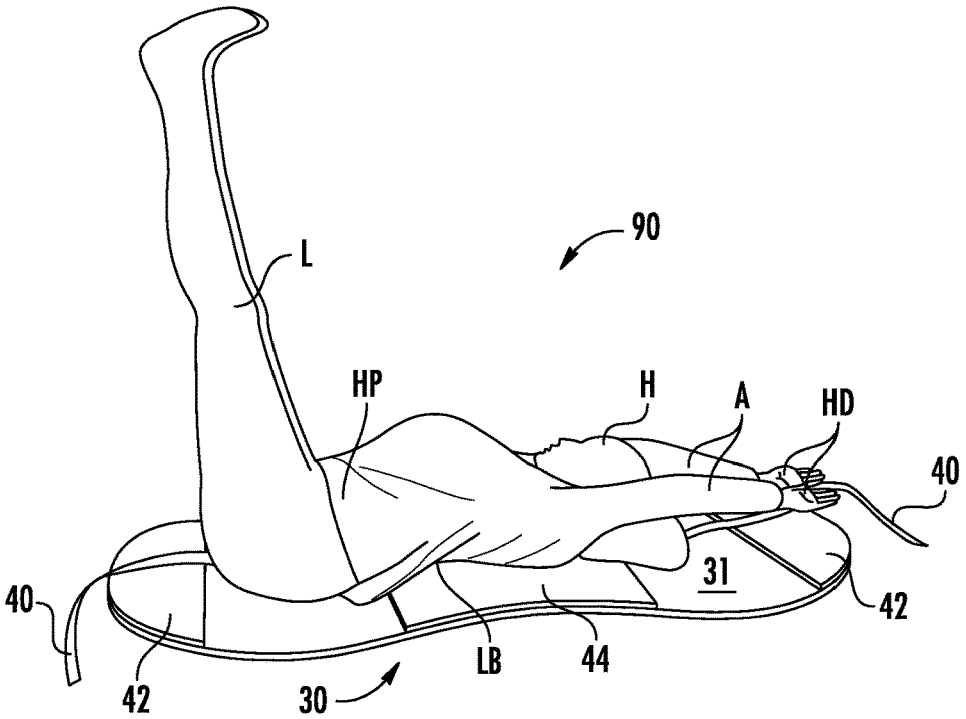
FIG. 16 illustrates a method associated with the apparatus shown in FIG. 1 for facilitating exercise and training according to yet another exemplary embodiment of the present invention.

FIG. 16 illustrates a method of using the apparatus 20 for facilitating physical exercise and training according to another exemplary embodiment of the invention. A user 90 is positioned lying face-up on the top surface 31 of the board 30 in the length L direction. The user 90 places the hips HP on the top surface 31 of the board 30 along the arch defined by the convex portion 34 and the concave portion 33 adjacent one of the opposed ends of the board 30 with the lower back LB positioned over the convex portion 34 at the center of the board 30. The user 90 fully extends the arms A and hands HD over the head H towards the end of the board 30, while bending the legs L upwards from the hips HP about ninety degrees. If desired, the user 90 may utilize the strap 40 to stabilize the upper body and to length the stretch of the arms A. The center pad 44 cushions and protects the lower back LB and the end pad 42 at one of the opposed ends of the board 30 cushions and supports the hands HD of the user 90. In this position, the curvature of the convex portion 34 at the center of the board 30 allows the hips HP to drop downwards relative to the lower back LB of the user 90, and thereby supports leg extension to more comfortably facilitate abdominal (e.g., core) exercise and training.

Figure 17:
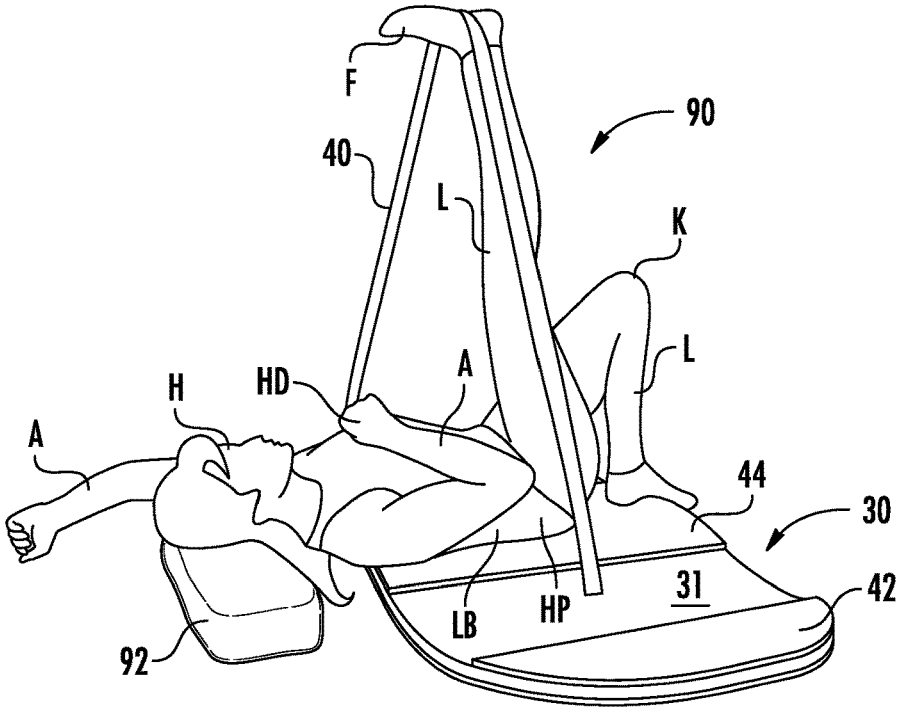
FIG. 17 illustrates a method associated with the apparatus shown in FIG. 1 for facilitating exercise and training according to yet another exemplary embodiment of the present invention.

FIG. 17 illustrates a method of using the apparatus 20 for facilitating physical exercise and training according to another exemplary embodiment of the invention. A user 90 is positioned lying face-up on the top surface 31 of the board 30 in the width W direction. If desired, the user 90 may further position the head H on a support, commonly referred to as a block, 92. The user 90 places the lower back LB on the top surface 31 of the board 30 over the convex portion 34 at the center of the board 30. The user 90 extends one of the arms A over the head H away from the board 30 and block 92, while bending one of the legs L upwards from the hips HP about ninety degrees and fully extending the leg L. If desired, the other leg L may be bent slightly upwards from the hips HP less than about ninety degrees and bent downwards from the corresponding knee K about ninety degrees. If desired, the strap 40 may be wrapped over the foot F of the fully extended leg L and held taut to help the user 90 maintain the leg L in the fully extended and bent position. The center pad 44 cushions and protects the lower back LB and the block 92 cushions and supports the head H of the user 90. In this position, the convex portion 34 at the center of the board 30 serves to support the lower back LB and the hips HP of the user 90, and thereby allows for an increased lengthening of the hamstring muscle without undue stress to the lower back LB and/or the knees of the user 90 to more comfortably facilitate exercise and training.

Figure 18:
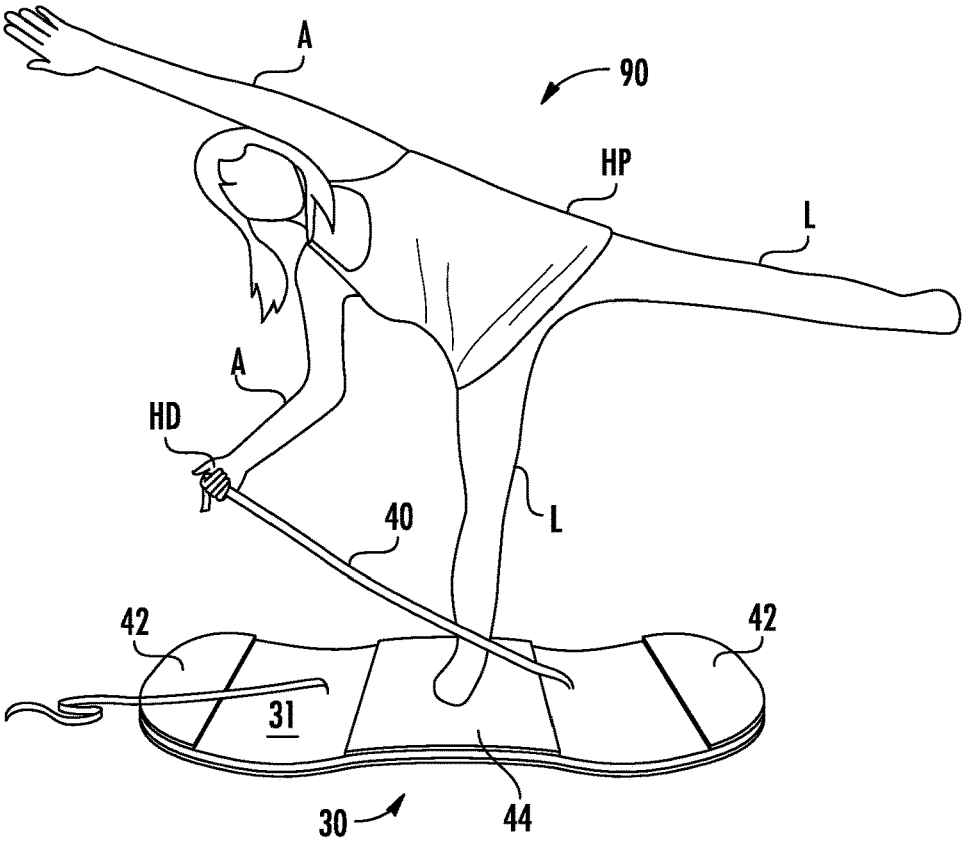
FIG. 18 illustrates a method associated with the apparatus shown in FIG. 1 for facilitating exercise and training according to yet another exemplary embodiment of the present invention.

FIG. 18 illustrates a method of using the apparatus 20 for facilitating physical exercise and training according to another exemplary embodiment of the invention. A user 90 is positioned standing on the top surface 31 of the board 30 facing in the width W direction. The user 90 places one foot F on the top surface 31 of the board 30 over the convex portion 34 at the center of the board 30. The user 90 grips one of the opposed ends of the strap 40 with one hand HD and bends the upper body sideways at the hips HP, while fully extending the free arm A and hand HD away from the hips HP. At the same time, the user 90 fully extends the corresponding leg L away from the hips HP substantially parallel to the extended arm A. The center pad 44 cushions and protects the foot F of the user 90 and the strap 40 stabilizes the user 90 on the board 30. In this position, the convex portion 34 at the center of the board 30 and the strap 40 serve to support the user 90 in a more balanced posture and with a fuller side opener position to more comfortably facilitate exercise and training.

Figure 19:
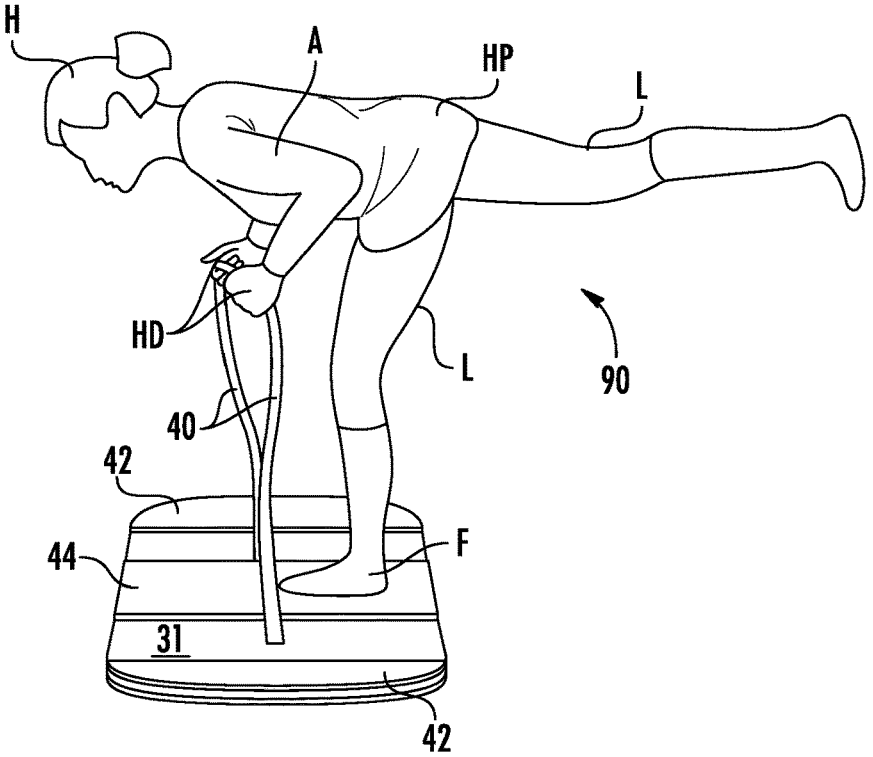
FIG. 19 illustrates a method associated with the apparatus shown in FIG. 1 for facilitating exercise and training according to yet another exemplary embodiment of the present invention.

FIG. 19 illustrates a method of using the apparatus 20 for facilitating physical exercise and training according to another exemplary embodiment of the invention. A user 90 is positioned standing on the top surface 31 of the board 30 facing in the width W direction. The user 90 places one foot F on the top surface 31 of the board 30 over the convex portion 34 at the center of the board 30. The user 90 grips the opposed ends of the strap 40 with both hands HD and bends the upper body forwards at the hips HP, while fully extending the free leg L away from the hips HP. The center pad 44 cushions and protects the foot F of the user 90 and the strap 40 stabilizes the user 90 on the board 30. In this position, the convex portion 34 at the center of the board 30 and the strap 40 serve to support the user 90 in a more balanced posture and with a greater lengthening position to more comfortably facilitate exercise and training.

Figure 20:
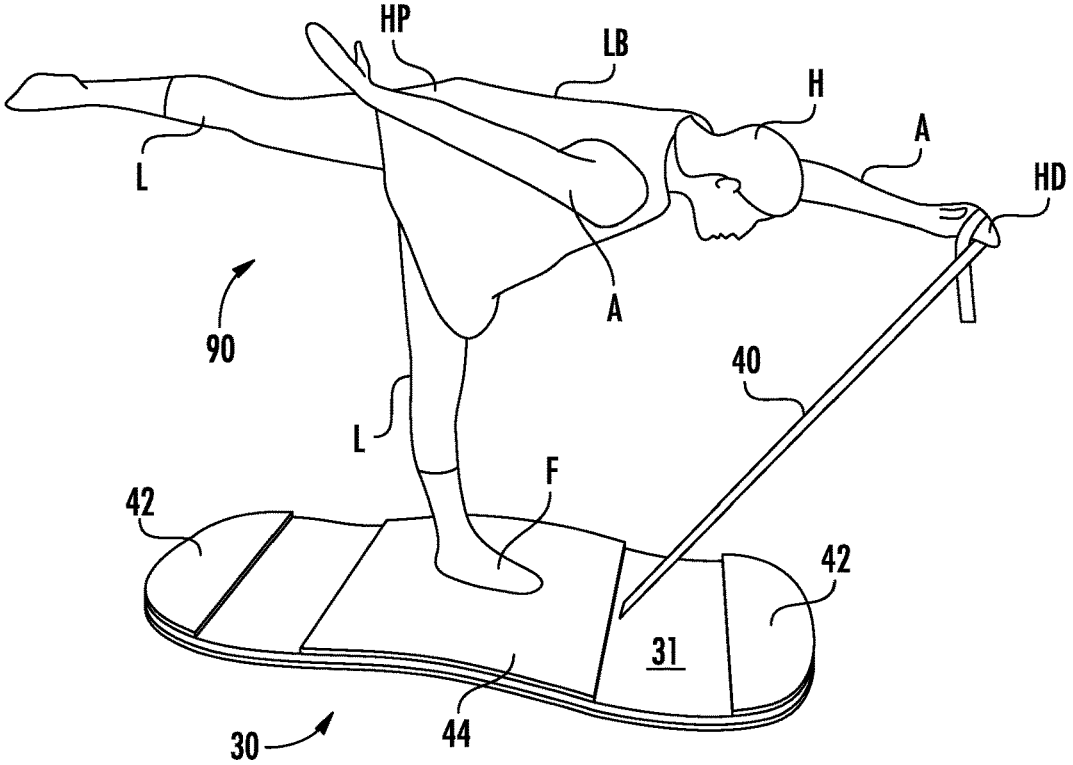
FIG. 20 illustrates a method associated with the apparatus shown in FIG. 1 for facilitating exercise and training according to yet another exemplary embodiment of the present invention.

FIG. 20 illustrates a method of using the apparatus 20 for facilitating physical exercise and training according to another exemplary embodiment of the invention. A user 90 is positioned standing on the top surface 31 of the board 30 facing in the length L direction. The user 90 places one foot F on the top surface 31 of the board 30 over the convex portion 34 at the center of the board 30. The user 90 grips one of the opposed ends of the strap 40 with one hand HD and bends the upper body forwards at the hips HP in the direction of the hand HD gripping the strap 40, while fully extending the free leg L away from the hips HP. The center pad 44 cushions and protects the foot F of the user 90 and the strap 40 stabilizes the user 90 on the board 30. In this position, the convex portion 34 at the center of the board 30 and the strap 40 serve to support the user 90 in a more balanced posture and achieve a successful "warrior 3 posture," to thereby strengthening the abdominal muscles (e.g., core and stabilizers) and more comfortably facilitate exercise and training.

Regardless of the foregoing detailed description of exemplary embodiments of the invention, the optimum configuration of the article of manufacture, apparatus, device or system, and the manner of use, operation and steps of the associated methods, as well as reasonable equivalents thereof, are deemed to be readily apparent and understood by those skilled in the art. Accordingly, equivalent relationships to those shown in the accompanying drawing figures and described in the written description are intended to be encompassed by the present invention given the broadest reasonable interpretation of the appended claims, the foregoing written description and the drawing figures being considered as illustrative only of the general concept and principles of the invention. Furthermore, as numerous modifications and changes will readily occur to those skilled in the art, the invention is not intended to be limited to the specific configuration, construction, materials, manner of use and operation of the exemplary embodiments shown and described herein. Instead, all reasonably predictable and suitable equivalents and obvious modifications to the invention should be construed as falling within the scope of the invention as defined by the appended claims given their broadest reasonable interpretation and construction to one of ordinary skill in the art within the context of the foregoing written description and accompanying drawing figures.

That which is claimed is:

1. An apparatus for facilitating exercise and training, comprising:

an elongate board defining a lengthwise direction and a widthwise direction with a length in the lengthwise direction being greater than a width in the widthwise direction, the elongate board having a top surface and a bottom surface opposite the top surface, the elongate board having opposed ends in the lengthwise direction and a center disposed between the opposed ends, the elongate board defining a complex curvature on the top surface in the lengthwise direction and an opposite complex curvature on the bottom surface in the lengthwise direction;

wherein the complex curvature on the top surface comprises an end convex portion adjacent each of the respective opposed ends that defines a local apex located between the respective opposed end and the center of the elongate board, a center convex portion at the center that defines a local apex located at the center of the elongate board, and a medial concave portion disposed between the center convex portion and each of the end convex portions; and wherein the top surface of the elongate board at each of the opposed ends is located below the local apex of the end convex portions and the local apex of the center convex portion.

2. The apparatus according to claim 1, wherein an aspect ratio of a length-to-width of the elongate board is between 1.5:1 and 3:1.

3. The apparatus according to claim 2, wherein the aspect ratio of the length-to-width of the elongate board is at least 2:1.

4. The apparatus according to claim 1, wherein the complex curvature on the bottom surface comprises an end concave portion adjacent each of the opposed ends of the elongate board, a center concave portion at the center of the elongate board, and a medial convex portion disposed between the center concave portion and each of the end concave portions.

5. The apparatus according to claim 1, further comprising a pair of openings formed through the elongate board on opposite sides of the center of the elongate board, and wherein an elongate strap is threaded upwardly through each of the pair of openings from the bottom surface of the elongate board to the top surface of the elongate board.

6. The apparatus of claim 1, further comprising a center pad overlying the center convex portion on the top surface of the elongate board and an end pad overlying each of the end convex portions on the top surface of the elongate board.

7. The apparatus of claim 1, further comprising an opening formed through the elongate board defining a handhold for gripping and lifting the elongate board.

8. The apparatus according to claim 1, wherein the elongate board is made of a plurality of layers of a laminated material.

9. The apparatus according to claim 1, wherein the elongate board is made of a material selected from the group consisting of wood, plastic and composite material.

10. The apparatus according to claim 1, wherein a thickness of the elongate board in a thickness direction perpendicular to the lengthwise direction and the widthwise direction is between 0.5 inches and 1.5 inches.

11. An exercise and training apparatus, comprising:

an elongate board defining a lengthwise direction and a widthwise direction with a length in the lengthwise direction being greater than a width in the widthwise direction, the elongate board having a top surface and a bottom surface opposite the top surface, the elongate board having opposed ends in the lengthwise direction and a center disposed between the opposed ends, the elongate board defining a complex curvature on the top surface in the lengthwise direction and an opposite complex curvature on the bottom surface in the lengthwise direction;

wherein the complex curvature on the top surface comprises an end convex portion adjacent each of the respective opposed ends that defines a local apex located between the respective opposed end and the center of the elongate board, a center convex portion at the center that defines a local apex located at the center of the elongate board, and a medial concave portion disposed between the center convex portion and each of the end convex portions, such that the top surface of the elongate board at each of the opposed ends is lower than the local apex of the end convex portions and the local apex of the center convex portion;

wherein the complex curvature on the bottom surface comprises an end concave portion adjacent each of the opposed ends of the elongate board, a center concave portion at the center of the elongate board, and a medial convex portion disposed between the center concave portion and each of the end concave portions; and wherein a pair of openings are formed through the elongate board on opposite sides of the center of the elongate board and an elongate strap is threaded upwardly through each of the pair of openings from the bottom surface of the elongate board to the top surface of the elongate board.

12. The apparatus of claim 11, further comprising a center pad overlying the center convex portion on the top surface of the elongate board and an end pad overlying each of the end convex portions on the top surface of the elongate board.

13. The apparatus of claim 11, further comprising an opening formed through the elongate board defining a handhold for gripping and lifting the elongate board.

14. The apparatus according to claim 11, wherein the elongate board is made of a plurality of layers of a laminated material.

15. The apparatus according to claim 11, wherein the elongate board is made of a material selected from the group consisting of wood, plastic and composite material.

* * * * *